US006296514B1

(12) United States Patent
Medina et al.

(10) Patent No.: US 6,296,514 B1
(45) Date of Patent: Oct. 2, 2001

(54) HIGH SPEED INTERFACE CONVERTER MODULE

(75) Inventors: Raul Medina; John J. Daly, both of Chicago, IL (US)

(73) Assignee: Stratos Lightwave, Inc., Chicago, IL (US)

( * ) Notice: Subject to any disclaimer, the term of this patent is extended or adjusted under 35 U.S.C. 154(b) by 0 days.

(21) Appl. No.: 09/669,416

(22) Filed: Sep. 25, 2000

Related U.S. Application Data

(63) Continuation of application No. 09/064,208, filed on Apr. 22, 1998, now Pat. No. 6,203,333.

(51) Int. Cl.[7] ..... H01R 4/24
(52) U.S. Cl. ..... 439/404
(58) Field of Search ..... 439/404, 417, 439/607, 610

(56) References Cited

U.S. PATENT DOCUMENTS 4,702,538 * 10/1987 Hutter ..... 439/417
5,055,064 * 10/1991 Imaizumi et al. ..... 439/402
5,071,366 * 12/1991 Bernardini ..... 439/417
5,848,914 * 12/1998 Lang ..... 439/610

* cited by examiner

*Primary Examiner*—Neil Abrams
(74) *Attorney, Agent, or Firm*—Karl D. Kovach; David L. Newman

(57) ABSTRACT

A module is provided for attaching to a flexible shielded cable including individual conductors. The module includes a die cast housing, a printed circuit board mounted within the die cast metal housing, a metal D-shell ribbon style host connector associated with the die cast metal housing, first and second apertures formed in the die cast metal housing, first and second guide tabs formed on the printed circuit board and arranged to protrude through the first and second apertures, and insulation displacement contact (IDC) connector header mounted within the die cast metal housing, and an insulation displacement contact (IDC) cover insert affixed to the die cast metal housing so as to engage individual conductors and forces the conductors onto the knife contacts of the IDC connector header when the two are brought together. The die cast metal housing having a base member and a cover. The module is hot pluggable.

3 Claims, 10 Drawing Sheets

HIGH SPEED INTERFACE CONVERTER MODULE

This is a continuation of U.S. patent application Ser. No. 09/064,208, filed Apr. 22, 1998, now U.S. Pat. No. 6,203, 333, which is hereby incorporated herein by reference.

BACKGROUND OF THE INVENTION

The present invention relates to an improved pluggable electronic module configured to connect and/or convert data signals from a first serial transmission medium to a second serial transmission medium. A preferred embodiment of the invention relates particularly to an improved GigaBaud Interface Converter (GBIC) as defined by the GBIC specification, the teaching of which is hereby incorporated herein by reference. However, the improvements disclosed in this specification are applicable to high speed data communication modules other than GBICs as well.

The GBIC specification was developed by a group of electronics manufacturers in order to arrive at a standard small form factor transceiver module for use with a wide variety of serial transmission media and connectors. The specification defines the electronic, electrical, and physical interface of a removable serial transceiver module designed to operate at Gigabaud speeds. A GBIC provides a small form factor pluggable module which may be inserted and removed from a host or switch chassis without powering off the receiving socket. The GBIC standard allows a single standard interface to be changed from a first serial medium to an alternate serial medium by simply removing a first GBIC module and plugging in a second GBIC having the desired alternate media interface.

The GBIC form factor defines a module housing which includes a first electrical connector for connecting the module to a host device or chassis. This first electrical connector mates with a standard socket which provides the interface between the host device printed circuit board and the module. Every GBIC has an identical first connector such that any GBIC will be accepted by any mating GBIC socket. The opposite end of the GBIC module includes a media connector which can be configured to support any high performance serial technology. These high performance technologies include: 100 Mbyte multi-mode short wave laser without OFC; 100 Mbyte single-mode long-wave laser with 10 km range; Style 1 intracabinet differential ECL; and Style 2 intracabinet differential ECL.

The GBIC module itself is designed to slide into a mounting slot formed within the chassis of a host device. The mounting slot may include guide rails extending back from the opening in the chassis wall. At the rear of the mounting slot the first electrical connector engages the mating socket which is mounted to a printed circuit board within the host device. The GBIC specification requires two guide tabs to be integrated with the electrical connector. As the connector is mated with the socket, the guide tabs of the connector engage similar structures integrally formed with the socket. The guide tabs are to be connected to circuit ground on both the host and the GBIC. The guide tabs engage before any of the contact pins within the connector and provide for static discharge prior to supplying voltage to the module. When the GBIC is fully inserted in this manner, and the connector fully mated with the socket then only the media connector extends beyond the host device chassis.

Copper GBIC's allow the host devices to communicate over a typical copper serial transmission medium. Typically this will comprise a shielded cable comprising two or four twisted pairs of conductors. In such GBIC's, the media connector will generally be a standard DB-9 electrical connector, or an HSSDC connector at each end. In the case of copper GBIC's this DB-9 or HSSDC connector is a purely passive device and serves no other function than to connect electrical signals between the cable and the GBIC module. Thus, it may be desirable to eliminate the media connector altogether, and directly attach two copper GBIC's, one at each end of the copper cable, thereby eliminating two connectors and reducing the cost of the data link. It may be further desired to make such direct attach copper GBIC's field installable such that the transmission cable may be routed and installed prior to attaching the GBIC modules. Such field installable GBIC's would help reduce the risk of damage to the modules while the wiring is being installed.

In designing GBIC modules, a factor which must be considered is that GBICs are high frequency devices designed to operate at speeds above 1 Gigabit per second. Thus, the modules carry the potential of emitting high frequency signals to the surrounding area which may adversely affect sensitive equipment situated nearby. Therefore, a sophisticated shielding mechanism is required in order to prevent such unwanted emissions. In prior art modules, this has generally included a metallized or metal clad portion of the module located adjacent the media connector. The metal portion is configured to engage the chassis wall of the host device when the module is fully inserted into the mounting slot. The metallized portion of the module and the chassis wall form a continuous metal barrier surrounding the mounting slot opening. The metal barrier blocks any high frequency emissions from escaping from the host chassis due to a gap between the GBIC module and the chassis mounting slot. A disadvantage of prior art GBIC modules, however, is that spurious emissions are free to escape the module directly through the media connector. This leakage has the potential of disrupting the operation of nearby devices. The problem is most acute in so called "copper GBICs" where an electrical connector is provided as the media connector. Furthermore, most prior art GBIC modules are formed of a plastic outer housing which allows EMI signals generated by the GBIC to propagate, freely within the chassis of the host device. These emissions can interfere with other components mounted within the host chassis and can further add to the leakage problem at the media end of the GBIC module.

Therefore, what is needed is an improved high speed pluggable communication module having an improved media connector end which acts to block all spurious emissions from escaping beyond the module housing. Such an improved module should be adaptable to function as a Giga-Bit interface converter module and interface with any GBIC receptacle socket. In such a module, the host connector should conform to the GBIC specification, and include the requisite guide tabs connected to the circuit ground. At the media end of the module, the improved module may include either an DB-9 style 1 copper connector, an HSSDC style 2 copper connector, or an SC duplex fiber optic connector as the second end media connector. Alternately, the module may provide for the direct attachment of the module to a copper transmission medium such that a single shielded copper cable may be interconnected between two host devices with an individual GBIC connected at each end. It is further desired that the module include plastic latching tabs to affirmatively lock the module into a corresponding host socket. Internally, the module should contain whatever electronics are necessary to properly convert the data signals from the copper transmission medium of the host device to whichever medium is to be connected to the media end of the module. In the case of GBIC modules, all of the operating parameters as well as mechanical and electrical requirements of the GBIC specification should be met by the improved module. However, though it is most desired to provide an improved GBIC module, it must be noted that the novel aspects of a transceiver module solving the problems outlined above may be practiced with high speed serial modules other than GBICS.

SUMMARY OF THE INVENTION

In light of the prior art as described above, one of the main objectives of the present invention is to provide an improved small form factor interface module for exchanging data signals between a first transmission medium and a second transmission medium.

A further object of the present invention is to provide an improved small form factor interface module configured to operate at speeds in excess of 1 Giga-Bit per second.

Another objective of the present invention is to provide an improved interface module to prevent spurious electromagnetic emissions from leaking from the module.

Another objective of the present invention is to provide an improved interface module having a die cast metal outer housing including a ribbon style connector housing integrally formed therewith.

Another objective of the present invention is to provide an improved interface module having a die cast metal outer housing including detachable insulated latch members for releasably engaging a host device socket.

Another objective of the present invention is to provide an improved interface module having a die cast metal outer housing with an integrally cast electrical connector, including guide tabs electrically connected to the circuit ground of the module and configured to engage similar ground structures within a host device socket.

Still another objective of the present invention is to provide an improved Giga-Bit Interface Converter (GBIC) having a media connector mounted remote from the GBIC housing.

An additional objective of the present invention is to provide an improved GBIC having a shielded cable extending from the module housing, with the cable shield being electrically connected to the housing in a manner which electromagnetically seals the end of the module housing.

A further objective of the present invention is to provide an improved GBIC having a remote mounted media connector comprising a DB-9 connector.

A still further objective of the present invention is to provide an improved GBIC having a remote mounted media connector comprising an HSSDC connector.

Another objective of the present invention is to provide an improved GBIC having a remote mounted media connector comprising an SC duplex optical transceiver.

Another objective of the present invention is to provide an improved GBIC module having a flexible shielded cable extending therefrom, and a second GBIC module being connected at the remote end of the cable wherein the two GBIC modules are field installable.

All of these objectives, as well as others that will become apparent upon reading the detailed description of the presently preferred embodiment of the invention, are met by the Improved High Speed Interface Converter Module herein disclosed.

The present invention provides a small form factor, high speed serial interface module, such as, for example, a Giga-Bit Interface Converter (GBIC). The module is configured to slide into a corresponding slot within the host device chassis where, at the rear of the mounting slot, a first connector engages the host socket. A latching mechanism may be provided to secure the module housing to the host chassis when properly inserted therein. It is desirable to have a large degree of interchangeability in such modules, therefore across any product grouping of such modules, it is preferred that the first connector shell be identical between all modules within the product group, thus allowing any particular module of the group to be inserted into any corresponding host socket. It is also preferred that the first connector include sequential mating contacts such that when the module is inserted into a corresponding host socket, certain signals are connected in a pre-defined sequence. By properly sequencing the power and grounding connections the module may be "Hot Pluggable" in that the module may be inserted into and removed from a host socket without removing power to the host device. Once connected, the first connector allows data signals to be transferred from the host device to the interface module.

The preferred embodiment of the invention is to implement a remote mounted media connector on a standard GBIC module according to the GBIC specification. However, it should be clear that the novel aspects of the present invention may be applied to interface modules having different form factors, and the scope of the present invention should not be limited to GBIC modules only.

In a preferred embodiment, the module is formed of a two piece die cast metal housing including a base member and a cover. In this embodiment the host connector, typically a D-Shell ribbon style connector, is integrally cast with the base member. The cover is also cast metal, such that when the module is assembled, the host end of the module is entirely enclosed in metal by the metal base member, cover, and D-Shell connector, thereby effectively blocking all spurious emissions from the host end of the module.

A printed circuit board is mounted within the module housing. The various contact elements of the first electrical connector are connected to conductive traces on the printed circuit board, and thus serial data signals may be transferred between the host device and the module. The printed circuit board includes electronic components necessary to transfer data signals between the copper transmission medium of the host device to the transmission medium connected to the output side of the module. These electronic components may include passive components such as capacitors and resistors for those situations when the module is merely passing the signals from the host device to the output medium without materially changing the signals, or they may include more active components for those cases where the data signals must be materially altered before being transmitted via the output medium.

In a further preferred embodiment, a portion of the printed circuit board extends through the cast metal D-Shell connector. The portion of the printed circuit board extending into the D-Shell includes a plurality of contact fingers adhered thereto, thereby forming a contact support beam within the metal D-Shell. Additional guide tabs extend from the printed circuit board on each side of the contact beam. The guide tabs protrude through apertures on either side of the D-Shell. A metal coating is formed on the outer edges of the guide tabs and connected to the ground plane of the printed circuit board. The guide tabs and the metal coating formed thereon are configured to engage mating structures formed within the host receiving socket, and when the module is inserted into the host receiving socket, the guide tabs act to safely discharge any static charge which may have built up on the module. The module housing may also include a metal U-shaped channel extending from the front face of the D-Shell connector adjacent the apertures formed therein, the channel forming a rigid support for the relatively fragile guide tabs.

Again, in an embodiment, an interface converter module includes a die cast metal base member and cover. Both the base member and the cover include mutually opposing cable supports. Each cable support defines a semicircular groove having a plurality of inwardly directed teeth formed around the circumference thereof. The opposing cable supports of the cover align with the corresponding cable supports of the base member. Each pair of opposing cable supports thereby form a circular opening through which a flexible shielded cable may pass, and the inwardly directed teeth formed within each groove engage the cable and secure the cable within the module. Furthermore, the outer layer of insulation of the cable may be stripped away such that a portion of the metallic shield is exposed. When stripped in this manner, the cable may be placed within the module with the outer layer of cable insulation adjacent a first and second pair of cable supports and the exposed shield portion of the cable adjacent a third and fourth pair of cable supports. The teeth of the first and second pair of cable supports compress the outer layer of insulation and secure the cable within the module. Similarly, the teeth of the third and fourth cable supports engage the exposed metal shield, thereby forming a secure electrical connection between the cast metal module housing and the cable shield. In order to ensure a secure connection with the cable shield, the radii of the semicircular grooves and the third and fourth cable supports are reduced to match the corresponding reduction in the diameter of the cable where the insulation has been stripped away. Further, the insulation of the individual conductors may be stripped such that the bare conductors may be soldered to individual solder pads formed along the rear edge of the module's printed circuit board.

In a similar embodiment, the module is made field installable. Rather than being soldered to the printed circuit board, the individual conductors may be connected utilizing an insulation displacement connector (IDC) mounted to the printed circuit board. In this embodiment the housing cover includes an IDC cover mounted on an inner surface of the cover. When the module is assembled, the IDC cover forces the individual conductors of the flexible cable onto knife contacts within the IDC connector. The knife contacts cut through the conductor's insulation to form a solid electrical connection with the copper wire within.

A media connector is attached at the remote end of the flexible shielded cable. The media connector may be configured as any connector compatible with the high performance serial transmission medium to which the module is to provide an interface. In the preferred embodiments of the invention, these connectors include a standard DB-9 connector or an HSSDC connector for applications where the module is interfacing with a copper transmission medium, or may include an SC duplex optical transceiver for those cases where the interface module is to interface with a fiber optic medium. Within the housing the various conductors comprising the flexible shielded cable are connected to the printed circuit board and carry the serial data signals between the remote media connector and the module. In an alternate configuration, the length of the flexible cable is extended and a second interface module substantially identical to the first module is connected to the remote end of the cable.

In another embodiment, the module includes a plastic housing having a metallized or metal encased end portion. The housing includes a first end containing a discrete host connector. The conductive portion of the housing is configured to engage the perimeter of the mounting slot in the metal chassis of the host device which receives the module. This metal to metal contact forms a continuous metal barrier against the leakage of spurious emissions. The conductive portion of the housing includes the end wall of the module housing opposite the end containing the connector. This end wall at the second end of the housing includes a small circular aperture through which a short section of a flexible shielded cable protrudes. The flexible cable includes a plurality of individual conductors which may be connected to electrical circuits formed on the printed circuit board, and the cable shield bonded to the conductive portion of the housing. In a first preferred embodiment the cable comprises a four conductor shielded cable, and in an alternative embodiment an eight conductor shielded cable is provided.

Thus is provided an adapter module for transmitting serial data signals between a first transmission medium and a second transmission medium. The module is defined by an electromagnetically sealed housing having first and second ends. The housing may be formed of die cast metal. The first end of the housing has a first connector attached thereto, which may be integrally cast with a base member of the housing. A flexible cable extends from the second end of the housing. The flexible cable includes a metallic shield which is bonded to the housing in a manner to electromagnetically seal the second end of the housing, thereby preventing high frequency electromagnetic emissions from escaping the housing. Individual conductors within the cable are connected to circuits mounted on a printed circuit board contained within the housing. Finally, a media connector is mounted at the remote end of the flexible cable for connecting to an external serial transmission medium.

BRIEF DESCRIPTION OF THE DRAWINGS

FIG. 6*a*—A DB-9 connector

FIG. 6*b*—An HSSDC connector

FIG. 6*c*—A second interface converter module

FIG. 6*d*—An SC duplex fiber optic connector; and

DETAILED DESCRIPTION OF THE PRESENTLY PREFERRED EMBODIMENTS

Figure 1:
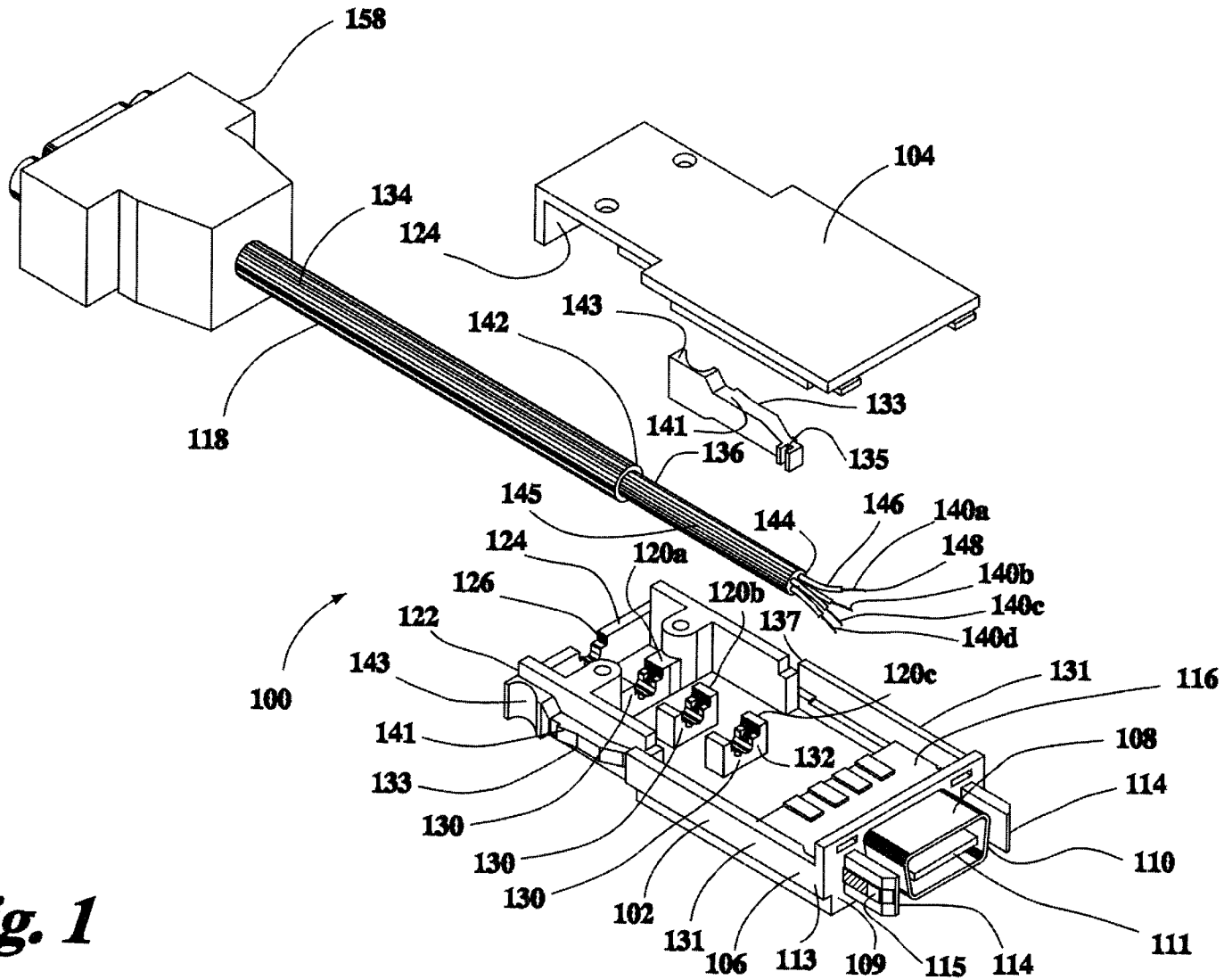
FIG. 1 is an exploded isometric view of an interface module according to the preferred embodiment of the invention.
Figure 2:
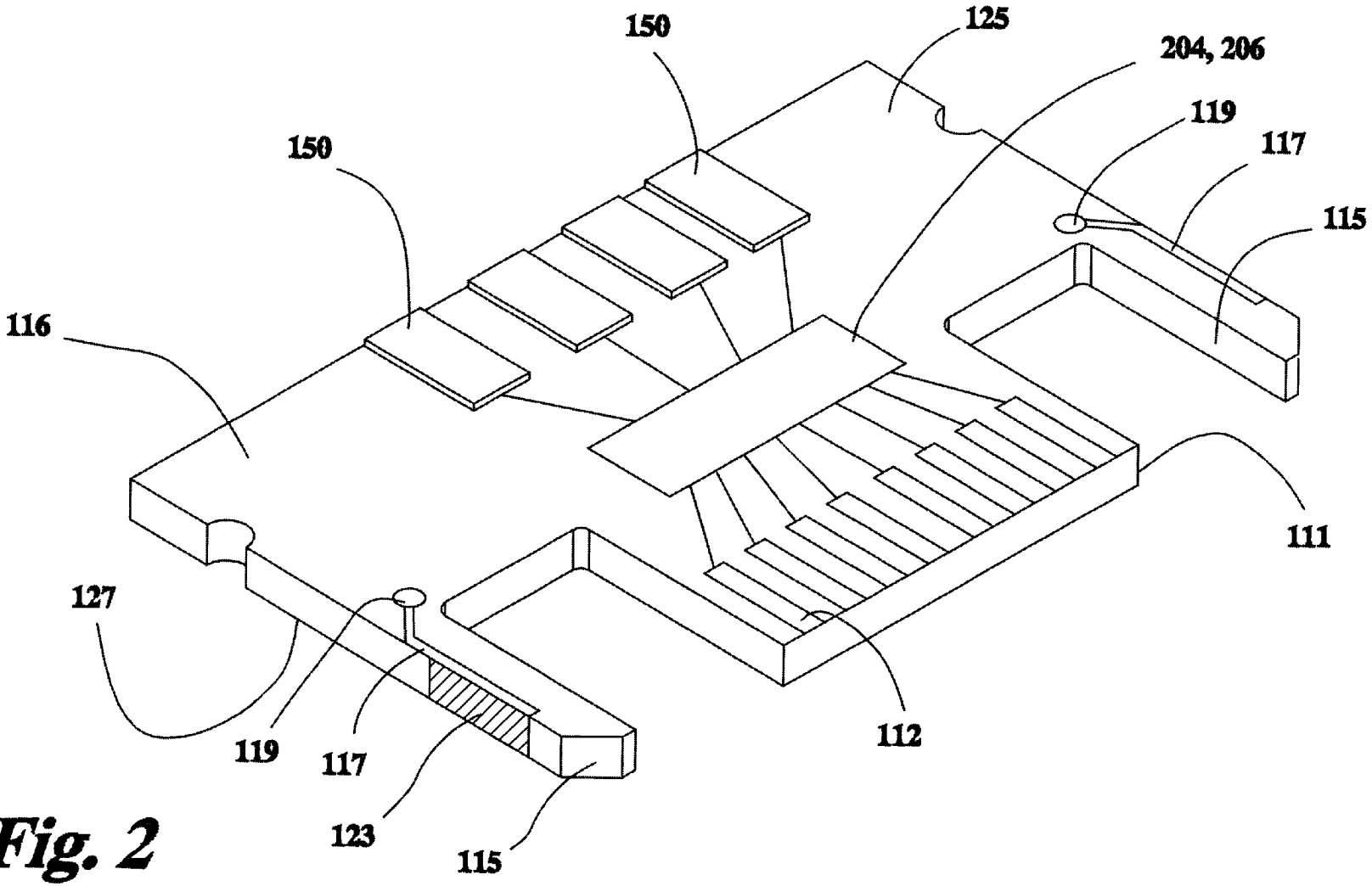
FIG. 2 is an isometric view of a printed circuit board to be mounted within the module housing shown in FIG. 1.

Referring to FIGS. 1, 2, 3 and 5, an interface module is shown according to a first embodiment of the invention 100. In this preferred embodiment, module 100 conforms to the GBIC specification, although the novel aspects of the invention may be practiced on other interface modules having alternate form factors. Module 100 includes a two piece die cast metal housing including a base member 102 and a cover 104. A first end of the housing 106 is configured to mate with a receiving socket located on a host device printed circuit board (host printed circuit board and socket not shown). The first end 106 of the housing is enclosed by a D-Shell ribbon style connector 108 which mates with the host device receiving socket. In this embodiment the D-Shell is entirely formed of metal which is integrally cast with the base member 102.

The D-Shell connector 108 includes a D-shaped shroud 110 which extends from a front end face plate 109 which extends across the front end of the module housing. The face plate 109 includes a pair of apertures 113 located on each side of the metal shroud 110, the apertures communicating with the interior of the module housing. A pair of U-shaped support channels 114 extend from the face plate 109 immediately adjacent each of the apertures 113. The support channels may be integrally cast with the remainder of base member 102. The D-Shell connector 108 further includes a contact beam 111 formed of an insulating material such as FR-4. Both the upper and lower surfaces of the contact beam have a plurality of contact elements 112 adhered thereto. When the connector 108 engages the host device socket, the contact elements 112 are held in wiping engagement against similar contact members formed within the socket. The physical connection between the contact members within the socket and the contact elements 112 allows individual electrical signals to be transmitted between the host device and the module.

The second end of the module 122, includes an end wall 124 contained partially on the base member 102, and partially on the cover 104. Mutually opposing semicircular grooves 126, 128 are formed in the end wall portions of the base member and cover respectively, such that when the cover is mated with the base member, the grooves form a circular opening in the end wall of the housing. Additionally, a plurality of cable supports 120*a*, 120*b*, 120*c* are formed on the inner surfaces of both the base member 102 and the cover 104 in axial alignment with the semicircular grooves formed in the end walls 124. Like the portions of the end wall 124 contained on the base member 102 and the cover 104, each cable support 120*a*. 120*b*, 120*c* includes a semicircular groove 130 which, when the cover and base member are joined, form a circular opening through each pair of mutually opposing cable supports. Both the semicircular grooves 126, 128 in the end wall and the semicircular grooves 130 in the cable supports include knob like radial projections or teeth 132.

The grooves 126, 128 in end wall 124 and the grooves 130 in the cable support members 120*a*, 120*b*, 120*c* act to support a flexible shielded cable 118 which protrudes from the second end of the module 100. The flexible cable includes an outer layer of insulation 134, and a metal shield 136 which surrounds a plurality of individually insulated conductors 140*a*, 140*b*, 140*c*, and 140*d*. In a first preferred embodiment, the flexible cable 118 includes four individual conductors, another embodiment requires eight conductors, and of course a cable employing any number of individual conductors may be used as required by a particular application. Installing the cable 118 in the module requires that the cable be stripped as shown in FIG. 1. First, the outer insulation 134 is stripped at 142, exposing an undisturbed section of the cable shield 136. Further down the length of the cable, the shield is stripped at 144 exposing the individual conductors 140*a*, 140*b*, 140*c*, and 140*d*. A layer of copper tape 145 may be applied to the end of the exposed shield to prevent the shield from fraying. Finally, the insulation of the individual conductors is stripped at 146 exposing the bare copper conductors 148 of each individual conductor. These exposed conductors are then soldered to contact pads 150 formed along the rear edge of printed circuit board 116.

Figure 3:
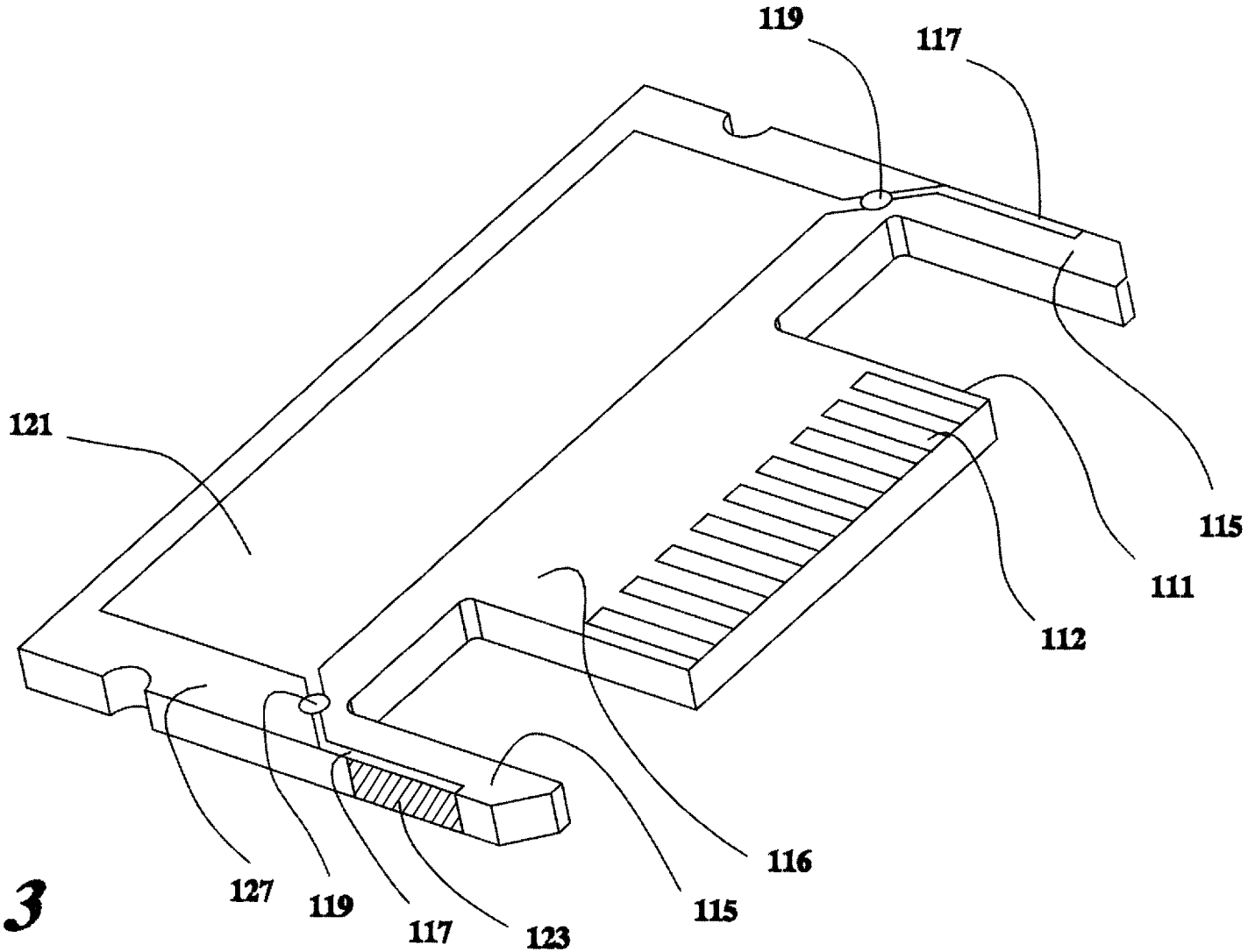
FIG. 3 is an isometric view of the printed circuit board in FIG. 2, showing the reverse side thereof.
Figure 4:
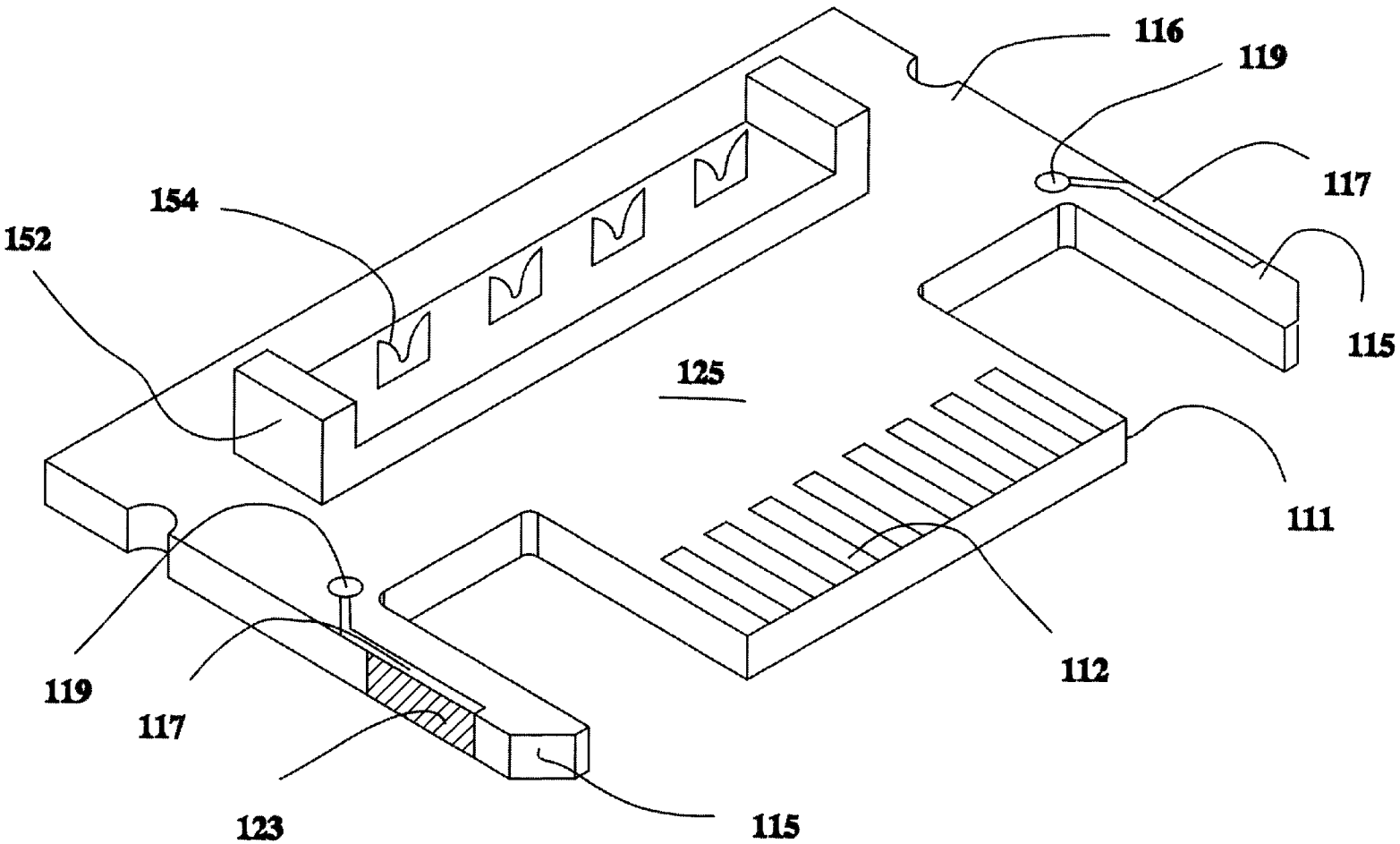
FIG. 4 is an isometric view of an alternate printed circuit board.
Figure 5:
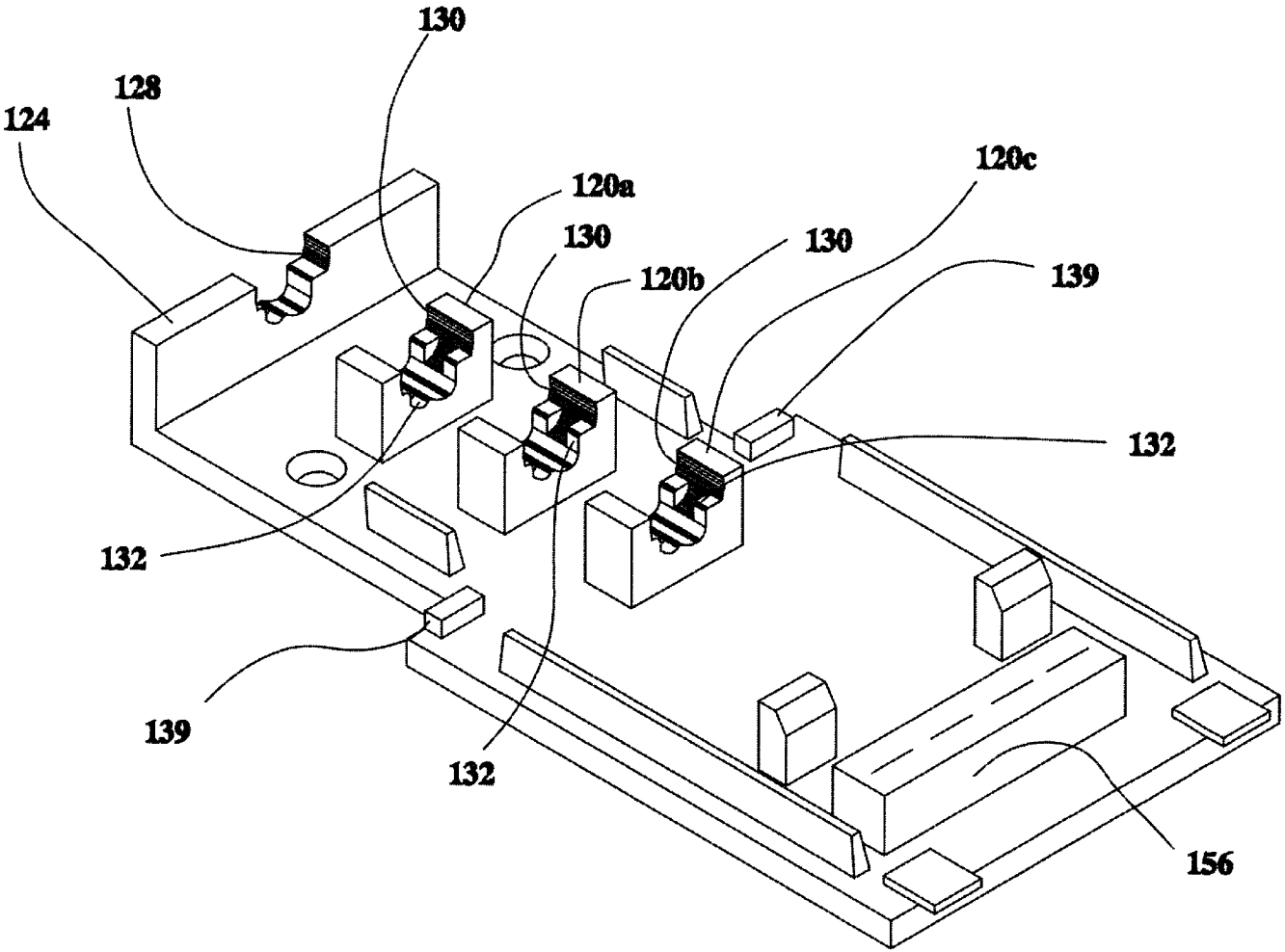
FIG. 5 is an isometric view of the module housing cover shown in FIG. 1, showing the interior surface thereof.

In an alternate printed circuit board arrangement depicted in FIG. 4, the solderpads 150 of FIG. 3 are replaced by a single insulation displacement connector 152. Mounted on the surface of printed circuit boards 116, the IDC connector includes a plurality of knife contacts configured to receive each of the individual conductors 140*a*, 140*b*, 140*c* and 140*d* of flexible cable 118. In this embodiment, the housing cover 104 includes an IDC cover 156 adhered to the inner surface of the housing cover. When the individual conductors 140 are placed over the knife contacts 154, and the cover 104 and base member 102 are assembled, the IDC cover 156 forces the conductors down onto the knife contacts 154. The knife contacts pierce the outer layer of insulation surrounding the conducts and make electrical contact with the copper conductors 148 contained therein. In this way, the module 100 may be easily field installed to a prewired copper cable.

Regardless of the attachment method, when the cable 118 is placed within the module housing, the manner in which the cable is stripped is such that the portion of the cable adjacent the end wall 124 and cable support 120*a*, nearest the end wall, includes the outer layer of insulation 134. When the module is enclosed by joining the cover 104 to the base member 102, the radial teeth 132 surrounding the mutually opposing grooves 126, 128 in the end wall and the mutually opposing grooves 130 in the first pair of cable supports 120*a*, dig into the compliant outer insulation to grip the cable and provide strain relief for the individual conductors soldered to the printed circuit board within. Further, the stripped portion of the cable wherein the metallic shield is exposed, lies adjacent the second and third cable supports 120*b*, 120*c*. The diameter of the grooves 130 formed in these supports is slightly smaller than the diameter of the grooves formed in the first cable support 120*a* and the outer wall 124. This allows the teeth 132 formed in the two inner cable supports 120*b*, 120*c* to firmly compress the reduced diameter of the exposed shield 136. The radial teeth and the cable supports themselves are formed of metal cast with the base member 104. Therefore, when the module is assembled, the cable shield will be electrically connected to the module housing. Thus, when the module is assembled and inserted into a host device chassis where the module housing will contact the host device chassis ground, the entire module, including the cable shield 136 shield will be held at the same electrical potential as the chassis ground.

Referring now to FIGS. 6*a*, 6*b*, 6*c*, and 6*d*, the remote end of the flexible cable 118 includes a media connector 158. The media connector may be of nearly any style which is compatible with the serial interface requirements of the communication system. Since the preferred embodiment of the invention is to comply with the GBIC specification, the preferred copper connectors are a DB-9 male connector, FIG. 6*a* or an HSSDC connector, FIG. 6*b*. It is also possible to mount an optoelectronic transceiver at the end of the flexible connector as in FIG. 6*a*, allowing the module to adapt to a fiber optic transmission medium. Another alternate configuration is to connect a second GBIC module directly to the remote end of the flexible cable, FIG. 6*c*. In this arrangement, the first GBIC may be plugged into a first host system device, and the second module plugged into a second system host device, with the flexible cable interconnected therebetween. The flexible cable acts as a serial patch cord between the two host devices, with a standard form factor GBIC module plugged into the host devices at either end. In a purely copper transmission environment, this arrangement has the advantage of eliminating a DB-9 connector interface at each end of the transmission medium between the two host devices.

Returning to FIGS. 1, 2 and 3, in the preferred embodiment of the invention, the contact beam 111 of connector 108 is formed directly on the front edge of printed circuit board 116. In this arrangement the contact beam protrudes through a rectangular slot formed in the face plate 109 within the D-shaped shroud 110. The contact elements 112 can then be connected directly to the circuitry on the printed circuit board which is configured to adapt the data signals between the copper transmission medium of the host device to the particular output medium of the module 100. Also extending from the front edge of the printed circuit board are a pair of guide tabs 115 located on each side of the contact beam 111. The guide tabs are configured to protrude through the apertures 113 formed in the face plate 109. Each guide tab is supported by the corresponding U-shaped channel 114 located adjacent each aperture. As can be best seen in FIGS. 2 and 3, each guide tab 115 includes an outer edge 123 which is coated or plated with a conductive material. The conductive material on the outer edge 123 of the guide tabs 115 is further electrically connected to narrow circuit traces 117, approximately 0.010" wide, located on both the upper 125 and lower 127 surfaces of the printed circuit board. The conductive traces 117 extend along the surfaces of the printed circuit board to conductive vias 119 which convey any voltage present on the traces from one side of the board to the other. On the lower surface 127 of the printed circuit board 116 the conductive vias are connected to the circuit ground plane 121 of the module.

The arrangement of the printed circuit board 116 and D-Shell connector 108 just described provide for proper signal sequencing when the module 100 is inserted into the receiving receptacle of a host device. As the connector 108 slides into a mating receptacle, the guide tabs 115 are the first structure on the module to make contact with the mating receptacle. The metal coating 123 on the outer edge of the tabs makes contact with a similar structure within the socket prior to any of the contact elements 112 mating with their corresponding contacts within the receptacle. Thus, the guide tabs 115 provide for static discharge of the module 100 prior to power being coupled to the module from the host device. The traces 117 formed along the upper and lower surfaces of the guide tabs are maintained as a very narrow strip of conductive material along the very edge of the guide tabs in order to provide as much insulative material between the static discharge contacts 123 and the metal U-shaped support channels 114. The U-shaped channels provide additional rigidity to the guide tabs 115.

In the preferred embodiment of the invention, the module 100 further includes longitudinal sides 131 extending between the first end 106 and second end 122 of the module housing. Latching members 133 associated with the longitudinal sides are provided to releasably secure the module 100 within the host receiving receptacle when the module is inserted therein. The latching members are formed of flexible plastic beams having a mounting base 135 configured to engage a slotted opening 137 formed within the side of base member 104. The mounting base 135 anchors the latching member within the slotted opening 137 and a brace 139 protruding from the inner surface of cover 104 acts to maintain the mounting base 135 within the slotted opening 137. The latching members further include latch detents 141 and release handles 143. As the module 100 is inserted into a receptacle, the latching members 133 are deflected inward toward the body of the housing. The angled shape of the latch detents allow the detents to slide past locking structures such as an aperture or stop formed on the inner walls of the receptacle. Once the detents slide past the locking structures, the latching members elastically spring outward, and the latch detents engage the locking structures, and the module is retained within the receptacle. To release the module, the release handles 143 must be manually squeezed inwardly until the latching detents clear the locking structures. At that point the module may be withdrawn from the socket with little difficulty.

Figure 6A:
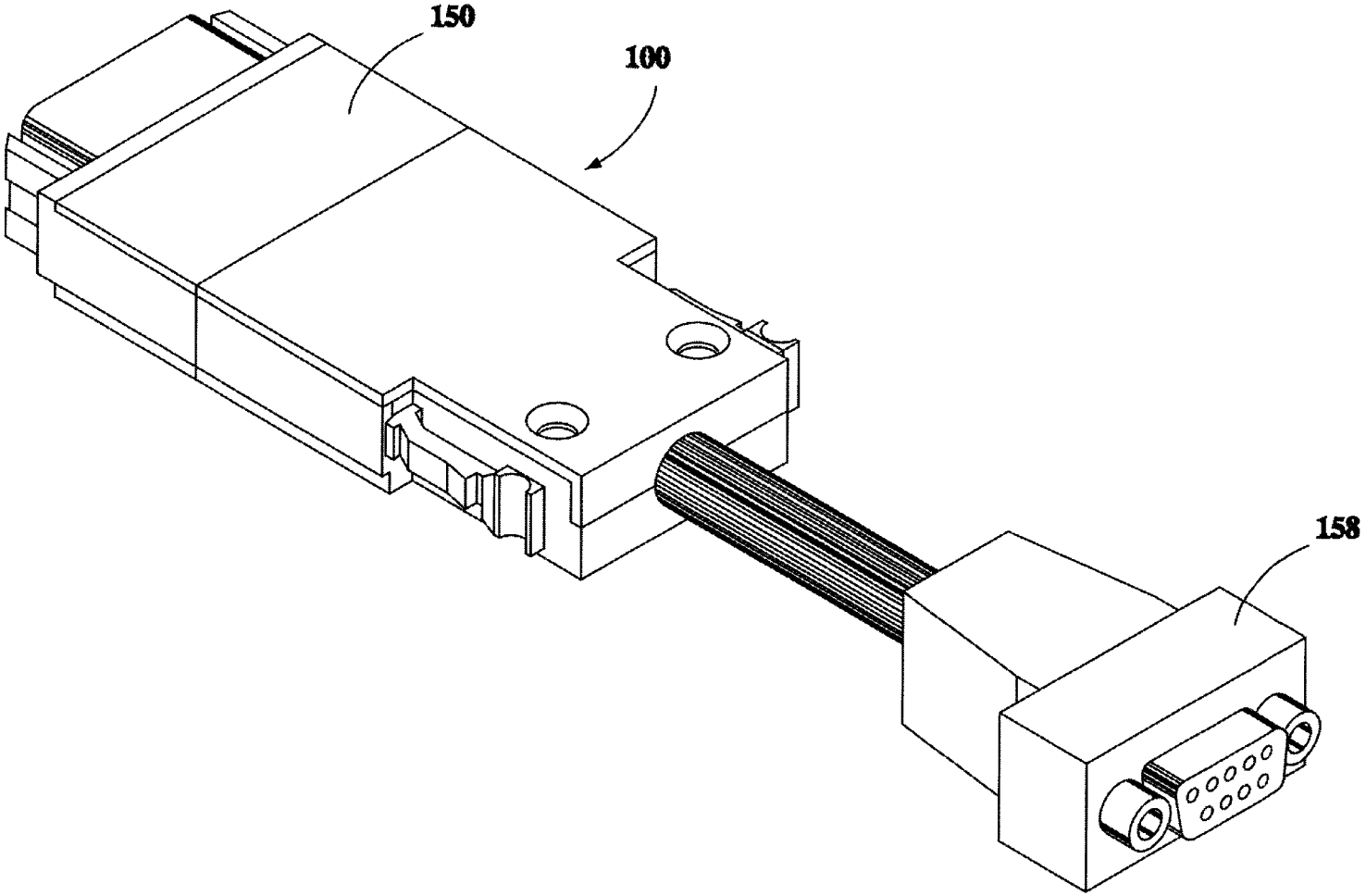
FIGS. 6*a*, 6*b*, 6*c* and 6*d* are isometric views of various interface converter modules according to the present invention, showing alternate media connectors including.
Figure 6B:
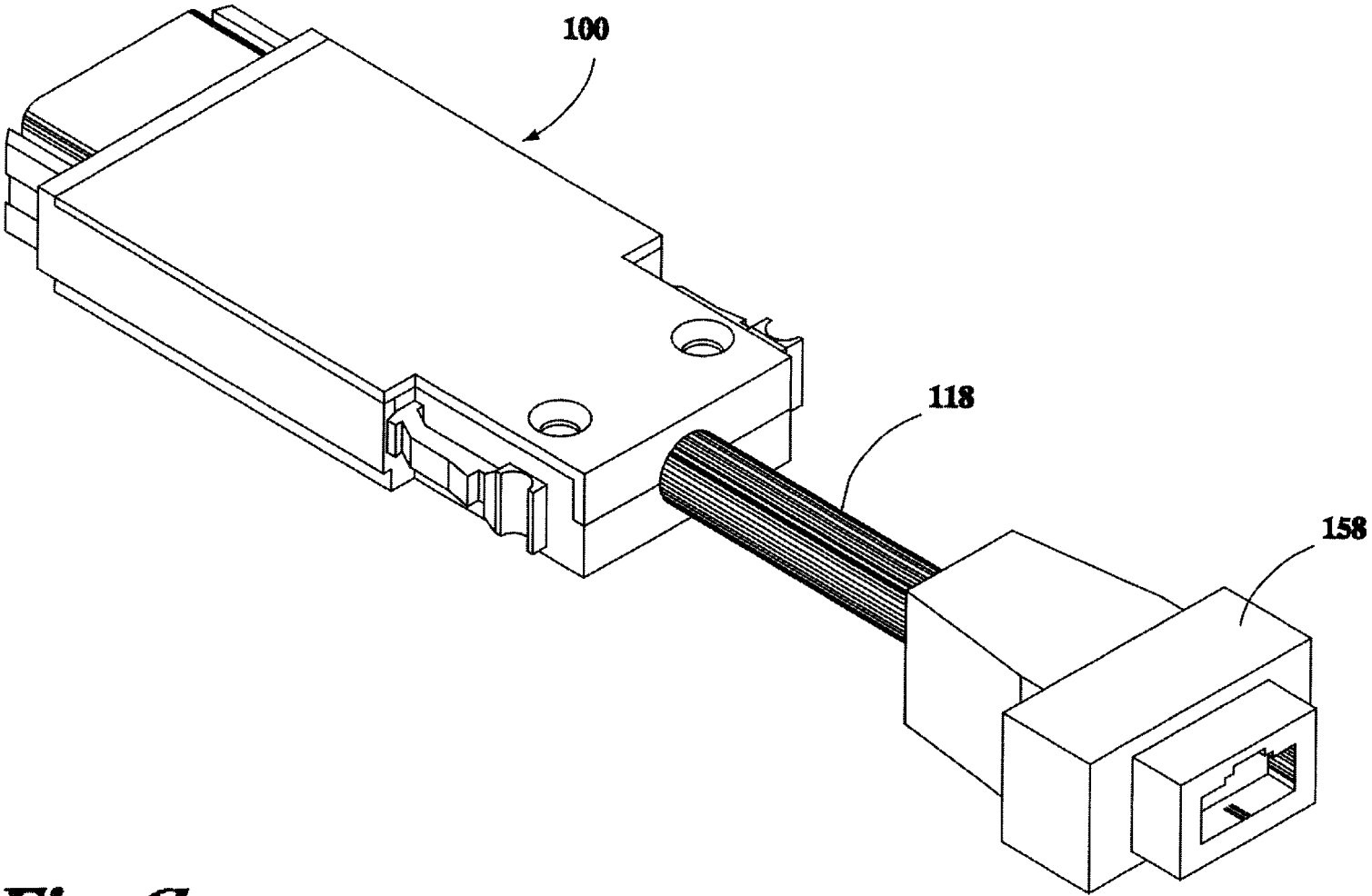
Figure 6C:
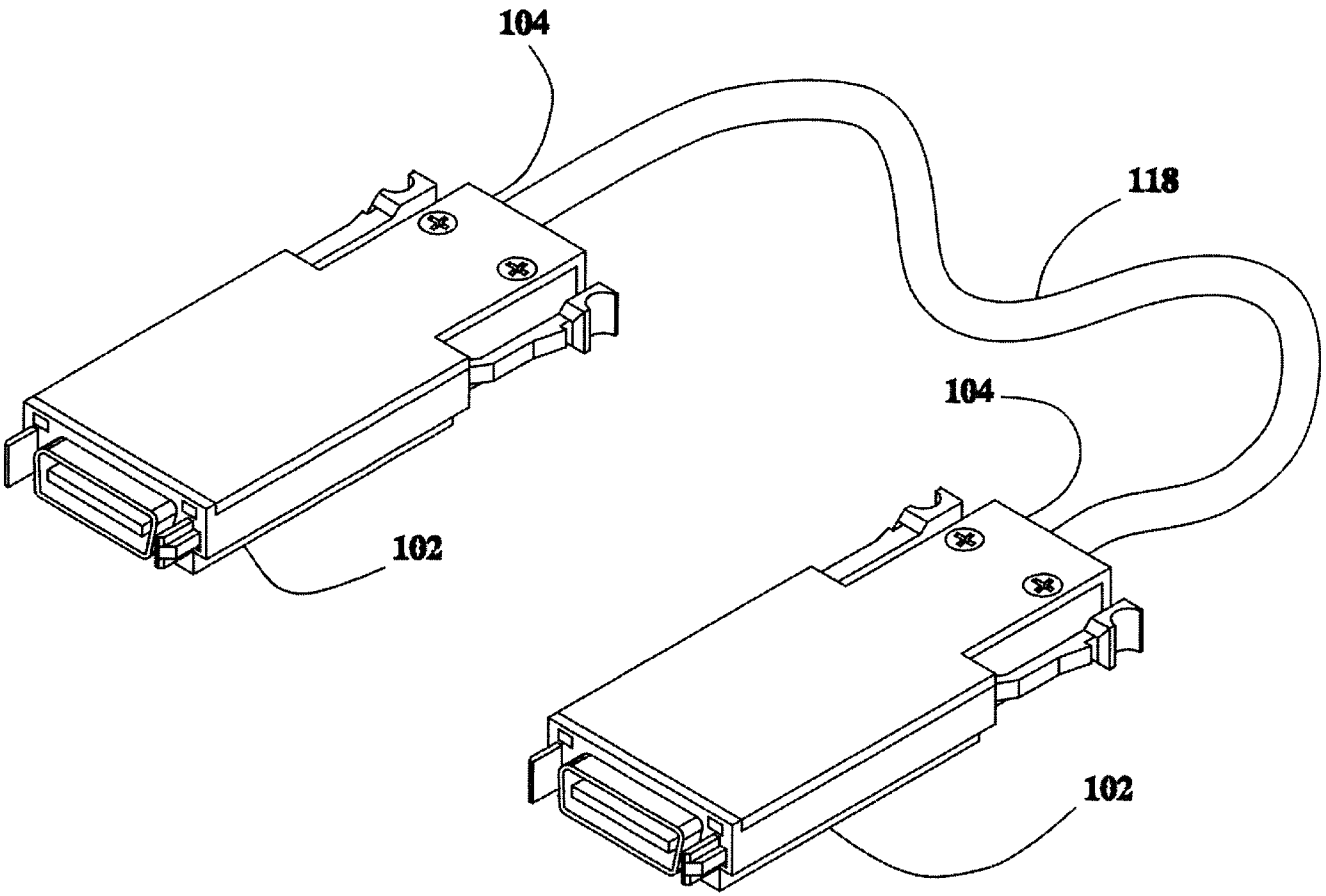
Figure 6D:
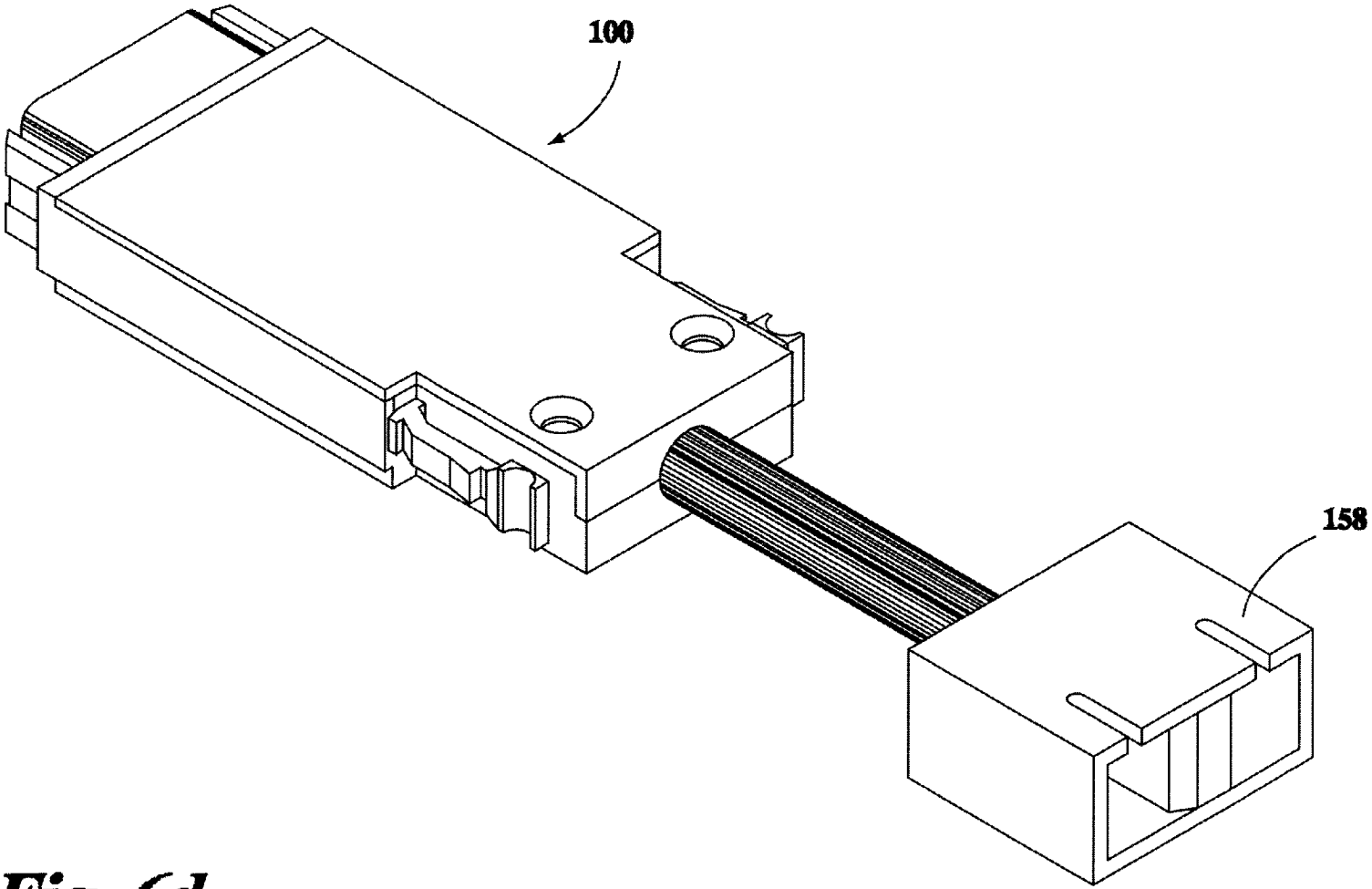

Referring again to FIGS. 1 and 5, an alternate embodiment to that just described is to form the housing base member 102 and cover 104 of a plastic material. In such an embodiment, the latch members 133 may be integrally molded directly with the base member 104. The D-Shell connector 108, however, requires a metal D-shaped shroud 110. Therefore, in this alternate embodiment the D-Shell connector must be provided separately from base member 104. Also, a plastic module housing will not be effective in reducing spurious electromagnetic emissions from leaking from the module. Therefore, some type of shielding must be provided at the second end 122 of the module to prevent such emissions from escaping the host device chassis when the module housing is inserted therein. As with prior art interface converter modules, this shielding may be provided by metallizing the plastic comprising the second end of the module, or by enclosing the second end of the module in a metal sheath 150 as is shown in the module of FIG. 6*a*. Regardless of the manner in which the shielding is supplied, all that is necessary is that the second end of the module be encased within a conductive material, and that the conductive material contact the host chassis when the module is inserted into the host device.

Returning to FIGS. 1 and 5, if the base member and cover are formed of plastic according to this alternate embodiment, the cable supports 120*a*, 120*b* and 120*c* must be formed of a conductive material separate from the base member 102 and cover 104. Furthermore, when the supports are joined to the base member 104 and the cover, provisions must be made for electrically connecting the conductive cable supports to the conductive material encasing the second end of the module. In this way, the cable shield 136 will be bonded to the outer conductive portion of the module, and the aperture in the end wall 124 through which the cable 118 exits the module will be electromagnetically sealed to block spurious emissions.

Figure 7:
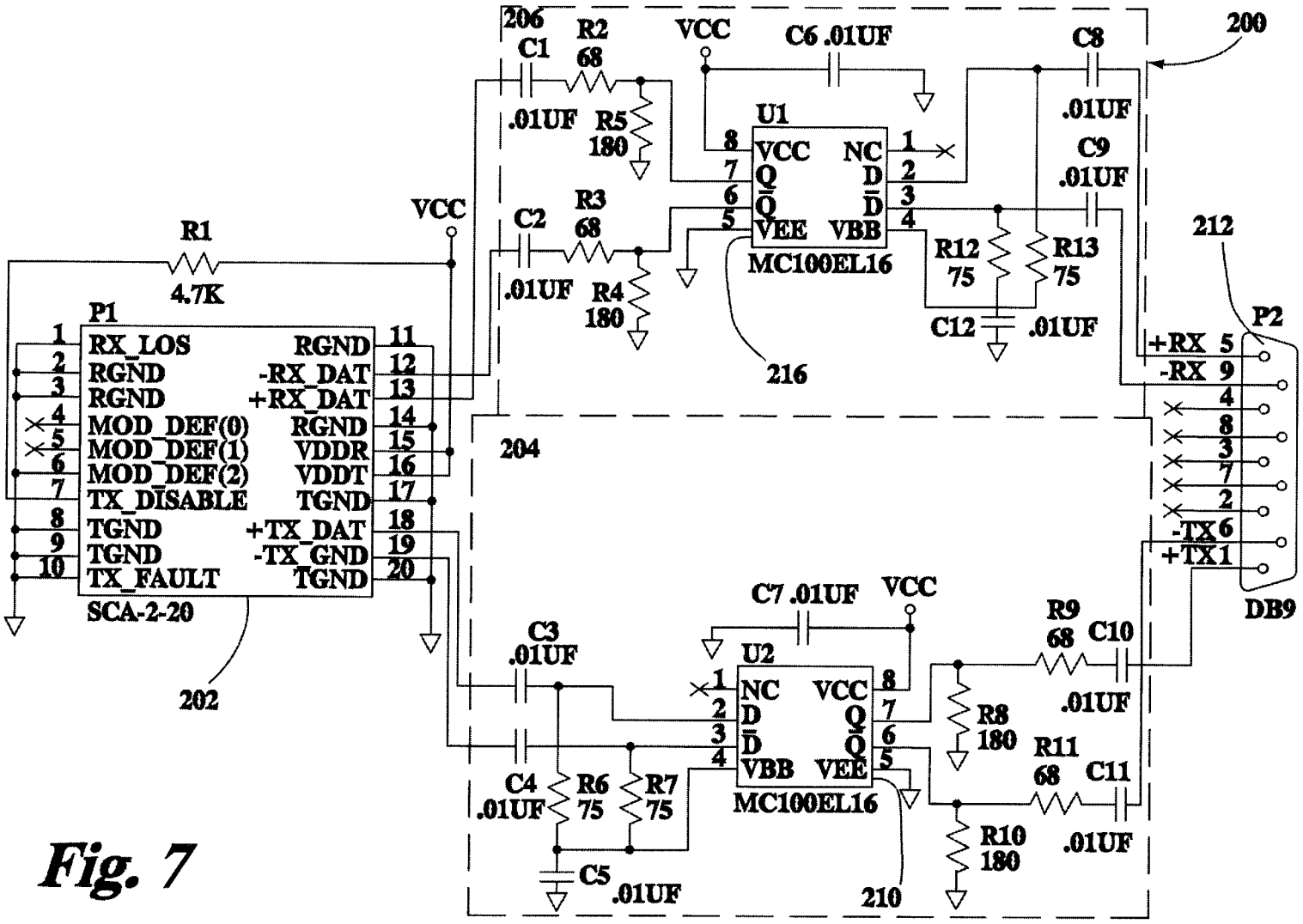
FIG. 7 is a schematic diagram of a passive copper GBIC according to the preferred embodiment of the invention.

Turning to FIG. 7, a schematic diagram of a active "copper GBIC" module 200 is shown according to a preferred embodiment of the invention. The module includes a host connector 202. As shown, contacts 1–3, 6, 8–11, 14, 17, and 20 of connector 202 are all connected ground, and contacts 4 and 5 are left unconnected. Contacts 12 and 13 represent the differential receive data inputs, contacts 15 and 16 are connected to the receive and transmit voltage supply $V_{CC}$, and pins 18 and 19 represent the differential transmit data outputs. A 4.7 KΩ resistor $R_1$ connects to the transmit disable pin 7, which disables the transmitter when $V_{CC}$ is not present.

The transmit portion of the module is shown within block 204. The transmit circuit includes 0.01 $\mu$F AC coupling capacitors $C_3$ and $C_4$, and 75Ω termination resistors $R_6$ and $R_7$. Resistors $R_6$ and $R_7$ form a 150Ω series resistance between the +transmit and the −transmit differential signal lines. The junction between $R_6$ and $R_7$ is AC coupled to ground by 0.01 $\mu$F capacitor $C_5$. The +transmit and −transmit signal lines are connected to the D and −D inputs of non-inverting PECL signal driver 210. Signal driver 210 acts as a buffer between the host device output drivers and the serial output transmission medium. Outputs Q and −Q of signal driver 210 are connected to the +transmit and −transmit signal lines of the serial transmission medium respectively. 180Ω resistor $R_8$ and 68Ω resistor $R_9$ provide proper biasing and termination of the +transmit signal, and capacitor $C_{10}$ AC couples the +transmit signal to the serial transmission medium. Similarly, 180Ω resistor $R_{10}$ and 68Ω resistor $R_{11}$ bias the output and series terminates the −transmit signal which is AC coupled to the serial transmission medium through capacitor $C_{11}$. The +transmit and −transmit signals are connected to the transmission medium via pins 1 and 6 of the DB-9 connector 212 respectively.

The receive portion of the module is shown within block 206. The receive circuit includes 0.01 $\mu$F AC coupling capacitors $C_8$ and $C_9$, and 75Ω termination resistors $R_{12}$ and $R_{13}$. Resistors $R_{12}$ and $R_{13}$ form a 150Ω series resistance between the +receive and the −receive 214 differential signal lines. The junction between $R_{12}$ and $R_{13}$ is AC coupled to ground by 0.01 $\mu$F capacitor $C_{12}$. The +receive and −receive signal lines are connected to the D and −D inputs of non-inverting PECL signal driver 216. Signal driver 216 acts as a buffer between the remote device output drivers and the receiving circuit of the host device. Outputs Q and −Q of signal driver 216 are connected to the +receive and −receive signal pins of the host connector 202. 180Ω resistor $R_5$ and 68Ω resistor $R_2$ provide proper output biasing and series termination of the +receive signal from the signal driver 216, and capacitor $C_1$ AC couples the +receive signal to the host device. Similarly, 180Ω resistor $R_4$ and 68Ω resistor $R_3$ providing biasing and series terminate the −receive signal, which is AC coupled to the serial transmission through capacitor $C_2$. The +receive and −receive signals are connected to the host device via contact elements 13 and 12 of connector 202 respectively.

The schematic diagram just described represents the preferred embodiment of an active "copper GBIC" interface converter module. Alternate schematics are known in the art, and it is well within the ordinary level of skill in the art to substitute more sophisticated circuit embodiments for the passive design disclosed herein. Such substitution would not require any undue amount of experimentation. Furthermore, it should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A module configured to attach to a flexible shielded cable including individual conductors, the module comprising:

a die cast metal housing including a base member and a cover, the die cast metal housing having a first end and a second end;

a printed circuit board mounted within the die cast metal housing;

a metal D-shell ribbon style host connector associated with the base member;

first and second apertures formed in the first end of the die cast metal housing located on each side of the metal D-shell ribbon style host connector;

first and second guide tabs integrally formed with and extending from a first end of the printed circuit board, the first guide tab being arranged to protrude through the first aperture, the second guide tab being arranged to protrude through the second aperture, each of the first and second guide tabs having a conductive material adhered to at least one side thereof and electrically connected to a circuit ground plane formed on the printed circuit board;

an IDC connector header mounted within the die cast metal housing and positioned to receive the individual conductors of the flexible shielded cable, the IDC connector header including a plurality of knife contacts; and an IDC cover insert affixed to the cover of the die cast metal housing and positioned such that, when the cover of the die cast metal housing is attached to the base member, the IDC cover insert engages the individual conductors, forcing the conductors onto the knife contacts of the IDC connector header.

2. The module according claim 1 wherein the cover of the die cast metal housing and the base member further comprise at least one cable support including a shield clamping member for engaging a metal shield of the flexible shielded cable, and forming an electrical connection between the die cast metal housing and the metal shield of the flexible shielded cable.

3. The module according to claim 2, further comprising a layer of copper tape applied to the metal shield of the flexible shielded cable.

* * * * *